US007887049B2

(12) United States Patent
Maul et al.

(10) Patent No.: US 7,887,049 B2
(45) Date of Patent: Feb. 15, 2011

(54) SHEET BRAKE SYSTEM FOR BRAKING PRINTED SHEETS, SHEET DELIVERY HAVING THE SHEET BRAKE SYSTEM AND PRINTING PRESS HAVING THE SHEET DELIVERY

(75) Inventors: Albert Maul, Heidelberg (DE); Michael Diews, Birkenau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 387 days.

(21) Appl. No.: 11/829,446

(22) Filed: Jul. 27, 2007

(65) Prior Publication Data

US 2008/0023907 A1 Jan. 31, 2008

Related U.S. Application Data

(60) Provisional application No. 60/834,882, filed on Aug. 2, 2006.

(30) Foreign Application Priority Data

Jul. 27, 2006 (DE) ..... 10 2006 035 559

(51) Int. Cl.
*B65H 29/68* (2006.01)

(52) U.S. Cl. ..... 271/183; 271/182

(58) Field of Classification Search ..... 271/207, 271/182, 183; 198/833, 835
See application file for complete search history.

(56) References Cited

U.S. PATENT DOCUMENTS 2,583,471 A * 1/1952 Collis ..... 198/835
4,651,983 A * 3/1987 Long ..... 271/35
5,402,996 A * 4/1995 Long ..... 271/9.07
5,938,006 A * 8/1999 Fisher ..... 198/831
6,598,872 B1 * 7/2003 Gunschera et al. ..... 271/197
6,659,453 B2 * 12/2003 Kelm et al. ..... 271/183
6,871,849 B2 * 3/2005 Kerpe et al. ..... 271/182
7,210,679 B2 * 5/2007 Schafer et al. ..... 271/183
7,275,742 B2 * 10/2007 Schafer et al. ..... 271/182
2001/0026042 A1 * 10/2001 Kerpe et al. ..... 271/183
2005/0284734 A1 * 12/2005 Rettore et al. ..... 198/833

FOREIGN PATENT DOCUMENTS

DE 3939212 A1 * 6/1990
DE 10103235 A1 10/2001
DE 102005013654 A1 11/2005

* cited by examiner

*Primary Examiner*—Stefanos Karmis
*Assistant Examiner*—Patrick Cicchino
(74) *Attorney, Agent, or Firm*—Laurence A. Greenberg; Werner H. Stemer; Ralph E. Locher

(57) ABSTRACT

A sheet brake system for braking printed sheets includes a plurality of brake elements each circulating about at least one respective geometric revolution axis, and a common drive roll for driving the brake elements. The drive roll circulates about a geometric roll axis and is connected in drive terms to each brake element through a frictional contact of the drive roll. The roll axis is disposed offset eccentrically relative to the at least one revolution axis of each brake element. The brake elements can, for example, be brake bands. A sheet delivery having the sheet brake system and a printing press having the sheet delivery, are also provided.

8 Claims, 7 Drawing Sheets

SHEET BRAKE SYSTEM FOR BRAKING PRINTED SHEETS, SHEET DELIVERY HAVING THE SHEET BRAKE SYSTEM AND PRINTING PRESS HAVING THE SHEET DELIVERY

CROSS-REFERENCE TO RELATED APPLICATIONS

This application claims the priority, under 35 U.S.C. §119, of German Application DE 10 2006 035 559.8, filed Jul. 27, 2006, this application also claims the priority, under 35 U.S.C. §120, of U.S. Provisional Application No. 60/834,882, filed Aug. 2, 2006; the prior applications are herewith incorporated by reference in their entirety.

BACKGROUND OF THE INVENTION

Field of the Invention

The present invention relates to a sheet brake system for braking printed sheets, including a plurality of brake elements each circulating about at least one respective geometric revolution axis, and a common drive roll for driving the brake elements. The drive roll circulates about a geometric roll axis and is connected in drive terms to each brake element through a frictional contact of the drive roll. The invention also relates to a sheet delivery having the sheet brake system and a printing press having the sheet delivery.

Such a sheet brake system is described in German Published, Non-Prosecuted Patent Application DE 10 2005 013 654 A1. In that sheet brake system of the prior art, the brake elements are configured as endless brake bands which are disposed so as to wrap around the drive roll, with the result that the drive roll is connected in drive terms to each brake band through a direct frictional contact between the drive roll and the inner face of the brake band. In that case, the roll axis of the drive roll forms a revolution axis of the brake band. A disadvantage of that sheet brake system is firstly that the wear-related exchange of the brake bands requires dismantling of the drive roll, in order for it to be possible for the fresh brake bands to be threaded onto the latter. Secondly, it is disadvantageous that, although the brake bands can be displaced along the drive roll manually for the purpose of sheet format adaptation, that takes place only with great expenditure or even in a manner which cannot be automated.

German Published, Non-Prosecuted Patent Application DE 101 03 235 A1, corresponding to U.S. Patent Application Publication No. US 2001/0026042 A1 and U.S. Pat. No. 6,871,849, describes a sheet brake system, in which the brake elements are driven through a common square shaft. The square shaft is connected in drive terms to each brake element through a gearwheel mechanism. A disadvantage of that sheet brake system is that its structural concept does not permit an adjustment of the brake elements optionally into a position parallel to the sheet running direction and into an oblique position with respect to the sheet running direction. However, the oblique position with respect to the sheet running direction could be advantageous in many print jobs with regard to transverse tautening of the printed sheets. Furthermore, it is disadvantageous that the gearwheel mechanism is unavoidably subjected to tooth play which has the effect of what is known as reversing play in the case of dynamic loading of the gearwheel mechanism. There would be particularly great dynamic loading of the gearwheel mechanism if the sheet brake system were operated as what is known as a cyclical sheet brake system, in which the brake elements are decelerated and accelerated in a manner which corresponds with the conveying cycle of the printed sheets. In that case, pronounced wear of the gearwheel mechanism and, as a consequence, an increase in the reversing play would occur, which can lead to the brake elements no longer running synchronously with one another and the sheet stack, onto which the sheet brake system deposits the printed sheets, becoming imprecise and unstable.

SUMMARY OF THE INVENTION

It is accordingly an object of the invention to provide a sheet brake system for braking printed sheets, a sheet delivery having the sheet brake system and a printing press having the sheet delivery, which overcome the hereinafore-mentioned disadvantages of the heretofore-known devices of this general type and in which brake elements can be exchanged without great expenditure. In particular, the invention is based on the further object of providing a sheet brake system having a format setting capability which can be automated readily. The invention is especially based on the further object of providing a sheet brake system which can be adapted in a simple manner to different print jobs, some of which require transverse tautening of the sheets and others do not. In particular, it is a further object of the invention to provide a sheet brake system which can be highly loaded dynamically.

With the foregoing and other objects in view there is provided, in accordance with the invention, a sheet brake system for braking printed sheets. The sheet brake system comprises a plurality of brake elements each circulating about at least one respective geometric revolution axis, and a common drive roll for driving the brake elements. The drive roll circulates about a geometric roll axis. The drive roll is connected in drive terms to each of the brake elements through a frictional contact of the drive roll. The roll axis is disposed offset eccentrically relative to the at least one revolution axis of each of the brake elements. The term "offset eccentrically" means that the roll axis and the revolution axis are not coaxial with one another or are not aligned with one another or are not one and the same geometric axis.

According to one variant of the invention, in which the brake elements in each case circulate about a single geometric revolution axis, the roll axis is offset eccentrically relative to the single revolution axis of the respective brake element. In this case, the brake elements can, for example, be brake disks, each brake disk having a geometric rotational axis which forms the single geometric revolution axis and about which the brake disk circulates.

According to the other variant of the invention, in which the brake elements in each case circulate about a plurality of geometric revolution axes, the roll axis is offset eccentrically relative to each of the revolution axes of the respective brake element. In this case, the brake elements can be configured, for example, as endless brake bands or belts which in each case circulate about a plurality of rollers and therefore wrap around them. The geometric rotational axes of the rollers form a plurality of revolution axes, about which the respective brake band or the respective brake belt circulates.

The drive roll rotates about the geometric roll axis. If the brake elements are configured as brake disks, the roll axis is oriented in parallel relative to the rotational axis of the respective brake disk, at least in one defined setting of the sheet brake system. If the brake elements are configured as brake bands or belts, the roll axis is oriented in parallel relative to the rotational axes of all rollers which are wrapped around by the respective brake band or belt, at least in one defined setting of the sheet brake system.

The sheet brake system according to the invention is advantageous in various ways. If they are worn as a result of the friction with the printed sheets, the brake elements can be replaced by new brake elements without dismantling of the drive roll. An adjustment of the brake elements along the drive roll, which takes place for the purpose of format setting of the sheet brake system, can be motorized or automated without problems. This structural concept makes mounting of the brake elements possible, in which the brake elements can be pivoted relative to the conveying or running direction of the printed sheets optionally into parallel positions and into oblique positions for transverse tautening of the sheets. Reversing play is avoided by the frictional contact, with the result that the sheet brake system is suitable for use as a cyclical sheet brake system. In a cyclical sheet brake system of this type, the brake elements are decelerated and accelerated periodically in a manner which corresponds with the conveying cycle of the printed sheets. As a result of the reversing play being avoided, the brake elements also run synchronously with one another when the gear mechanism, through which the brake elements are driven, is subjected to the highly dynamic alternating loadings of the cyclical sheet brake system.

In accordance with another feature of the invention, as has already been mentioned, the brake elements are configured as endless brake bands or belts and the brake elements do not wrap around the drive roll. In this case, the drive roll is therefore situated outside the brake bands or belts and is not pushed through the brake bands or belts.

In accordance with a further feature of the invention, each brake element has associated with it a friction wheel which bears against the drive roll to form the frictional contact. Accordingly, the friction wheels which roll on the drive roll are driven rotationally by the drive roll. The rotational movement of the friction wheels can be transmitted in various ways to the brake elements, as will be explained in the following text.

In accordance with an added feature of the invention, each friction wheel is loaded by at least one spring in order to ensure the frictional contact. In this case, the friction wheels are pressed against the drive roll by the springs.

In accordance with an additional feature of the invention, each brake element has associated with it a friction roller which is disposed coaxially with the revolution axis, and the respective friction wheel bears against the respective friction roller to form a further frictional contact. In this case, there is in each case one frictional contact between the drive roll and the friction wheels which bear against it and in each case the further frictional contact between the friction wheels and the friction rollers which bear against them. Each brake element has, as it were, associated with it a two stage friction wheel mechanism, the first mechanism stage of which is formed by the drive roll together with the friction wheel and the second mechanism stage of which is formed by the friction wheel together with the friction roller.

In accordance with yet another feature of the invention, in a deviation from the above-described variant, the friction roller can be omitted, with the respective friction wheel being disposed coaxially with the at least one geometric revolution axis of the respective brake element. According to this variant, each brake element is driven through a single stage friction wheel mechanism which is formed by the respective friction wheel together with the drive roll.

In accordance with yet a further feature of the invention, each brake element is a constituent part of a brake module which is mounted in such a way that it can pivot about a substantially vertical pivot axis. Accordingly, the brake modules can be pivoted together with the brake elements in a substantially horizontal plane. By pivoting the brake modules relative to one another, the brake elements can be adjusted from a position, in which the revolution axes of the brake elements are oriented perpendicularly relative to the conveying or running direction of the printed sheets, into oblique positions which serve to tauten the printed sheets transversely and in which the revolution axes of the brake elements are oriented neither perpendicularly nor parallel with respect to the sheet running direction.

In accordance with yet an added feature of the invention, each brake module is fastened to a module carrier which is mounted in such a way that it can pivot about a joint having a horizontal pivot axis. This development is advantageous with regard to ensuring the frictional contact between the drive roll and the friction wheel which is in rolling contact with the drive roll. In this case, the above-mentioned spring which is provided for ensuring the frictional contact is disposed in such a way that it loads the swinging arm and tends to pivot the swinging arm and therefore the friction wheel toward the drive roll.

In accordance with yet an additional feature of the invention, in which the two above-mentioned features are provided in combination with one another, each module carrier is connected in an articulated manner to a swinging arm with the formation of the substantially vertical pivot axis, and each swinging arm is connected to a carriage through the respective joint which has the horizontal pivot axis. This carriage can be displaced in the horizontal direction which is perpendicular with respect to the sheet running direction, in order for it to be possible for the sheet brake system to be set in accordance with the format of the printed sheets.

With the objects of the invention in view, there is also provided a sheet delivery which comprises the sheet brake system according to the invention or according to one of the features of the invention.

With the objects of the invention in view, there is concomitantly provided a printing press which comprises the sheet delivery according to the invention.

Other features which are considered as characteristic for the invention are set forth in the appended claims.

Although the invention is illustrated and described herein as embodied in a sheet brake system for braking printed sheets, a sheet delivery having the sheet brake system and a printing press having the sheet delivery, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
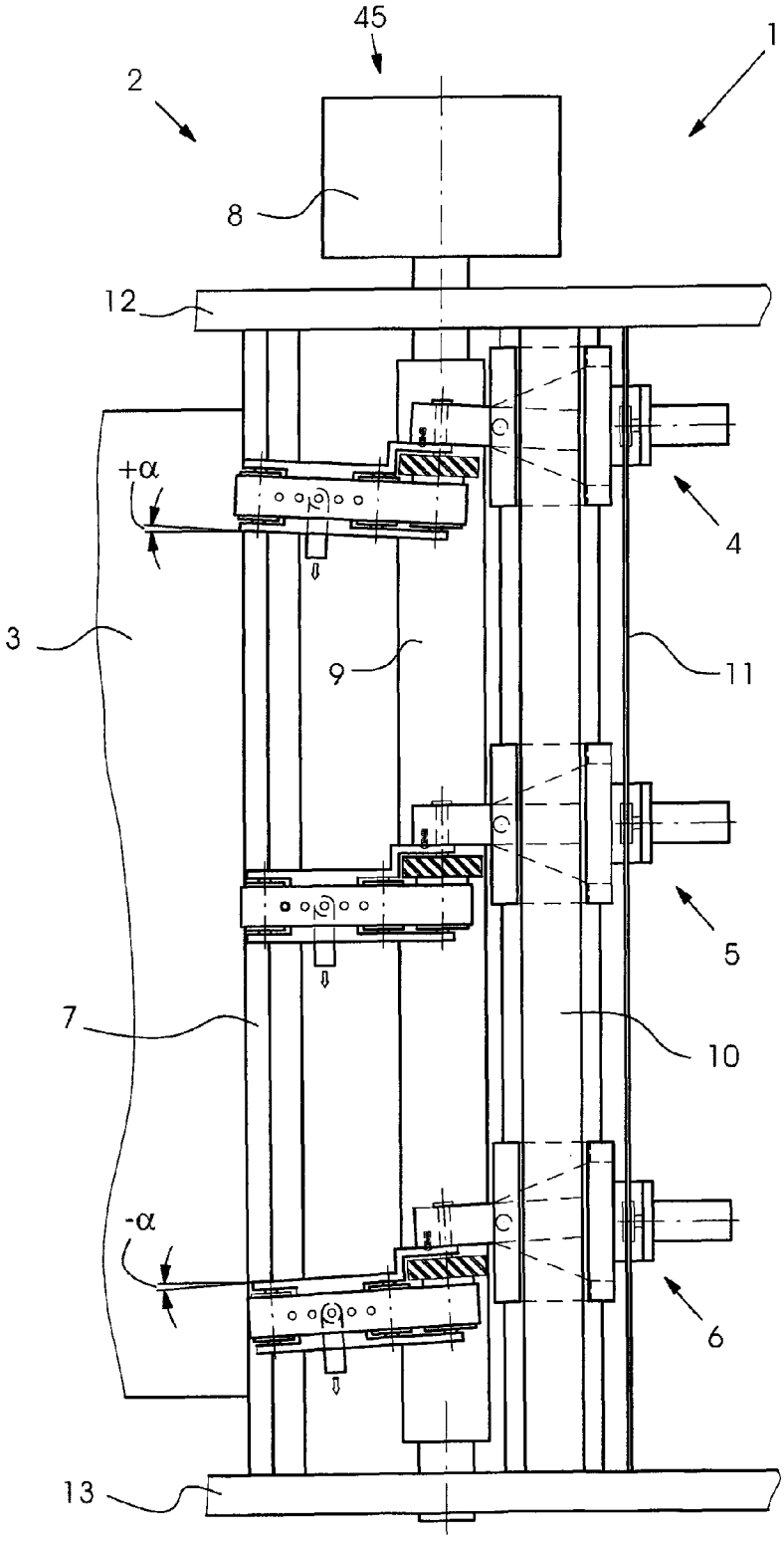
FIGS. 1 to 4 are fragmentary, diagrammatic, plan, enlarged plan, side-elevational and side-elevational views of a first exemplary embodiment of the invention, in which brake elements are configured as endless bands and friction wheels are disposed in alignment with band rollers.

Referring now in detail to the figures of the drawings in which elements and components that correspond to one another are denoted by the same designations, there is seen a printing press 1 for printing printed sheets, including a sheet delivery 45 having a sheet brake system 2. The sheet brake system 2 is disposed in front of a delivery stack 3 in the conveying or running direction of the printed sheets. The sheet delivery 45 deposits the printed sheets on the delivery stack 3. With regard to FIG. 1, the running direction of the printed sheets is from right to left. The sheet brake system 2 includes a plurality of sheet brakes which are distributed over the width of the printed sheet that is to be braked. In the illustrated example, there is one sheet brake 4 on the drive side of the printing press 1, one sheet brake 6 on the operating side and one central sheet brake 5 which lies between the outer sheet brakes 4, 6. The sheet brake system 2 could also include two further sheet brakes and therefore a total of five sheet brakes. All of the sheet brakes 4 to 6 are absolutely structurally identical, in particular the two outer sheet brakes 4, 6 as well. The sheet brakes are not of mirror-symmetrical construction with respect to one another, but are of identical construction. A divergent oblique position which can be seen in FIG. 1 of the two outer sheet brakes 4, 6 results from their setting which has been performed by the operator for the print job.

Furthermore, a sheet stop 7 for the rear edges of the printed sheets which are to be delivered belongs to the sheet delivery 45. With regard to their circulating movement, the sheet brakes 4 to 6 are driven by a common electric drive motor 8 through a common drive roll 9. The drive roll 9 rotates about a geometric roll axis 44. The drive motor 8 is disposed coaxially with the drive roll 9 and a motor shaft of the drive motor 8 is connected fixedly in terms of rotation to the drive roll 9. The sheet brakes 4 to 6 can be displaced along a guide cross member 10 which carries them transversely with respect to the running direction of the printed sheets, in order for it to be possible to position the sheet brakes 4 to 6 for the respective print job in accordance with the sheet format width and the position of print-free corridors on the printed sheets. These displacements take place by motor and with the assistance of a rack 11 which extends parallel to the guide cross member 10 on that side of the guide cross member 10 which lies opposite the drive roll 9.

Instead of the three sheet brakes 4 to 6 which are shown in FIG. 1, the sheet brake system 2 could also include five sheet brakes of this type, as has already been mentioned. During changeover of the printing press 1 from a pure recto printing operating mode, in which all five sheet brakes are used, to a recto and verso printing operating mode, in which only three of the five sheet brakes are used, a sheet brake system 2 of this type could be adjusted automatically, with the two outermost sheet brakes being moved along the guide cross member 10 into parking positions which are situated outside the width of the maximum sheet format that can be processed in the printing press 1. These parking positions can be assumed due to the narrowness of the sheet brakes.

Figure 2:
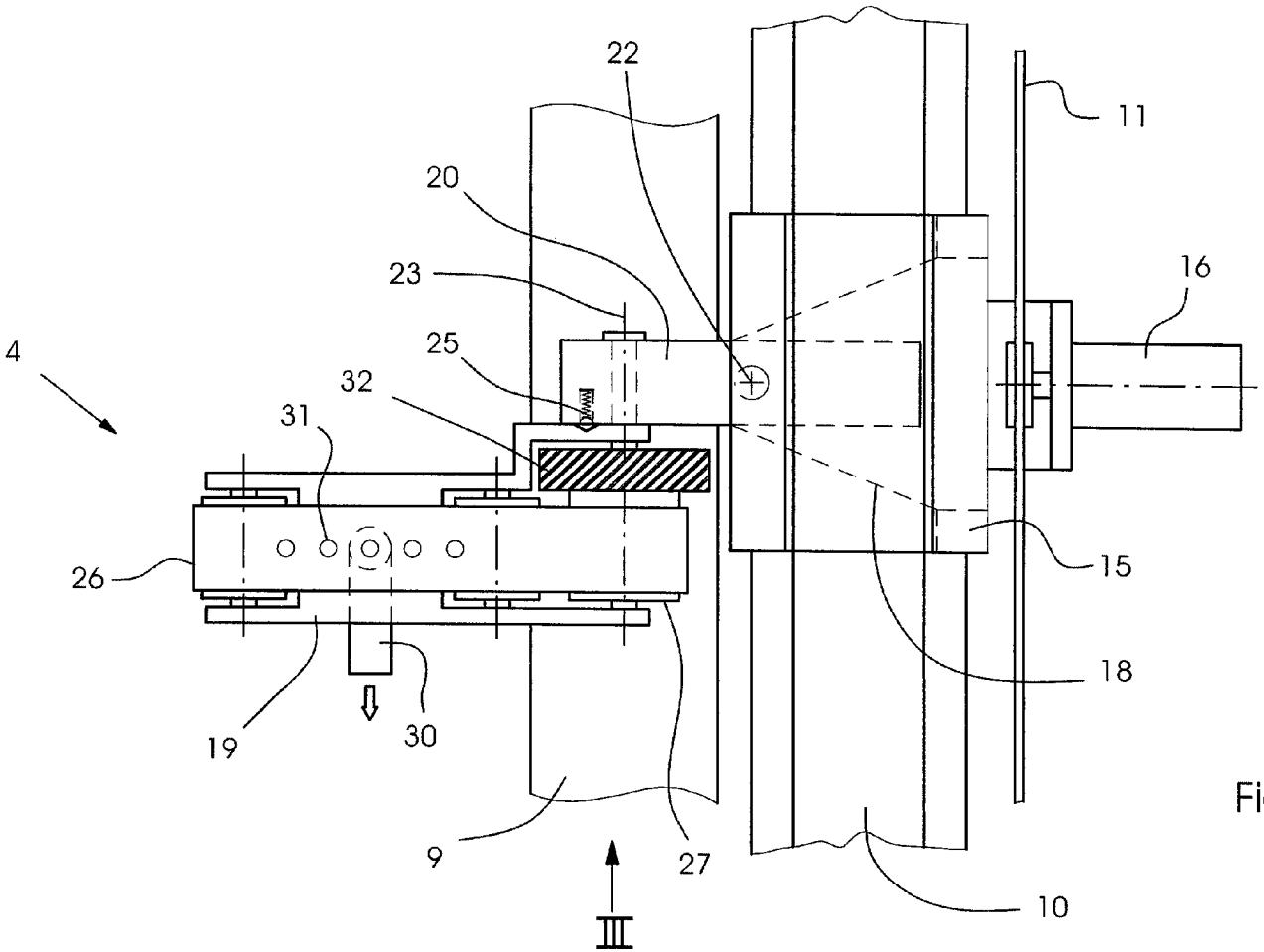
Figure 3:
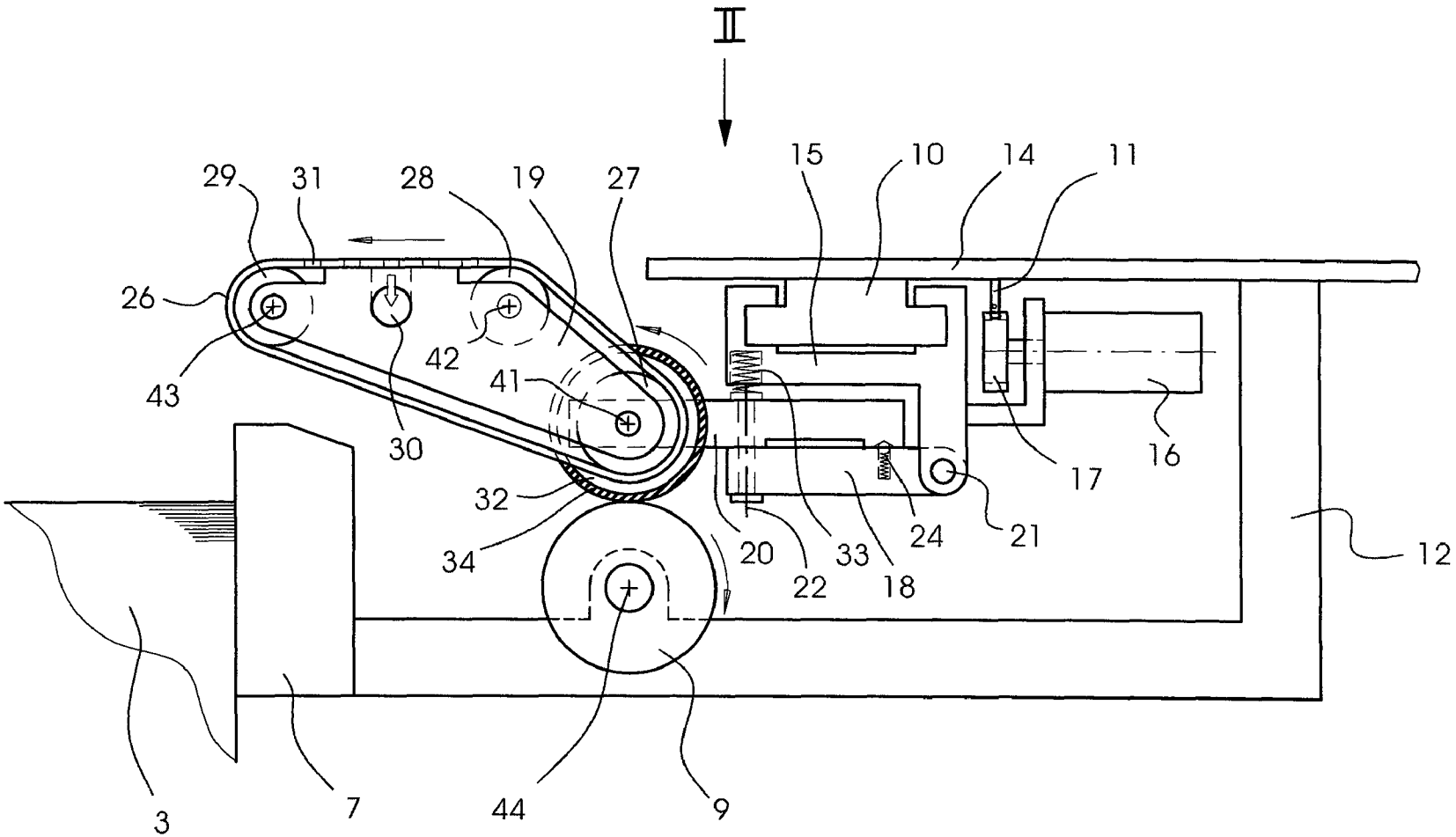

The drive roll 9 which is shown in FIG. 1 is mounted rotatably in a frame, to which a frame part 12 on the drive side and a frame part 13 on the operating side belong. FIGS. 2 and 3 use the example of the sheet brake 4 to show the construction of each sheet brake 4 to 6. FIG. 2 is a plan view according to a viewing direction II which is indicated in FIG. 3 and FIG. 3 is a side view according to a viewing direction III which is indicated in FIG. 2.

A sheet guiding plate 14 for guiding the printed sheets, which is shown in FIG. 3 and is disposed in front of the sheet brake system 2 in the running direction of the printed sheets, is omitted in FIGS. 1 and 2, in order to expose the view of the components which lie under the sheet guiding plate 14. The sheet brake 4 includes a carriage 15 which engages behind the guide cross member 10 that has a T-shaped profile (see FIG. 3). An electric actuating motor 16 is fastened to the carriage 15 by an angled part. The actuating motor 16 is connected to a pinion 17 which is seated on a motor shaft of the actuating motor 16 and engages in the rack 11. Activation of the actuating motor 16 brings about movement of the carriage 15 and therefore of the entire sheet brake 4 along the guide cross member 10 into the required position. The activation is controlled by an electronic control device, for example a central machine controller of the printing press 1, proceeding from data of the respective print job which are stored in it, with the result that the positioning of the sheet brakes 4 to 6 in a manner which is specific to the print job takes place automatically. Furthermore, the sheet brake 4 includes a swinging arm 18, a brake module 19 and a module carrier 20 for carrying the brake module 19. The swinging arm 18 is fastened to the carriage 15 through a joint 21 which has a horizontal pivot axis. The module carrier 20 is fastened to the swinging arm 18 through a joint which has a substantially vertical pivot axis 22. The brake module 19 is fastened to the module carrier 20 through a pivoting joint having a horizontal axis 23. The brake module 19 can be configured in such a way that it can be released from the module carrier 20 by the operator, with the result that the operator can remove the brake modules 19 of the sheet brakes which are not required for the following print job from the printing press 1 during changeover of the printing press 1. For example, during a changeover of the printing press 1 from a recto printing operating mode to a recto and verso printing operating mode, the operator could dismantle the brake modules of two of the total of five sheet brakes which are present. This dismantling could preferably take place without tools if the brake module is connected to the module carrier through a quick release device and, for example, the pivoting joint which has the horizontal axis 23 is configured as a quick release device of this type.

The module carrier 20 can be adjusted together with the brake module 19 optionally into various angular positions relative to the running direction of the printed sheets by pivoting the module carrier 20 and therefore also the brake module 19 about the pivot axis 22. In this way, the brake module 19 can be adjusted into an angular position which is parallel to the running direction of the printed sheets, as is demonstrated in FIG. 1 using the example of the central sheet brake 5. Moreover, the brake module 19 can be pivoted into an angular position which is oblique with respect to the running direction by a positive angle $+\alpha$ (shown in FIG. 1 using the drive-side sheet brake 4) and into an angular position which is oblique with respect to the running direction by a negative angle $-\alpha$ (shown in FIG. 1 using the operating-side sheet brake 6). An orientation of the brake modules of the two outer sheet brakes 4, 6 so as to diverge from one another in the running direction is preferred, as a result of which lateral tautening of the printed sheets during their braking is brought about, and an orientation of the brake module of the central sheet brake 5 which corresponds with the running direction is also preferred, as is shown in FIG. 1.

The more pronounced the divergence of the brake modules of the outer sheet brakes 4, 6 (that is to say, the greater the angles $+\alpha$, $-\alpha$) are, the more the printed sheet is tautened. Tautening of varying degrees from print job to print job can be required. Various amounts of the angles $-\alpha$, $+\alpha$ can therefore be set through the use of a latching device 24. Parts of the latching device 24 are a latching ball and a compression spring which loads the latching ball, that are seated in the swinging arm 18, and an arcuate row of index holes or notches which are made in the module carrier 20 and into which the latching ball enters during latching. In addition to the index holes which are provided for the various positive and negative angular positions, the row also includes an index hole for the locking of the module carrier 20 and the brake module 19 in parallel with the sheet running direction.

Figure 4:
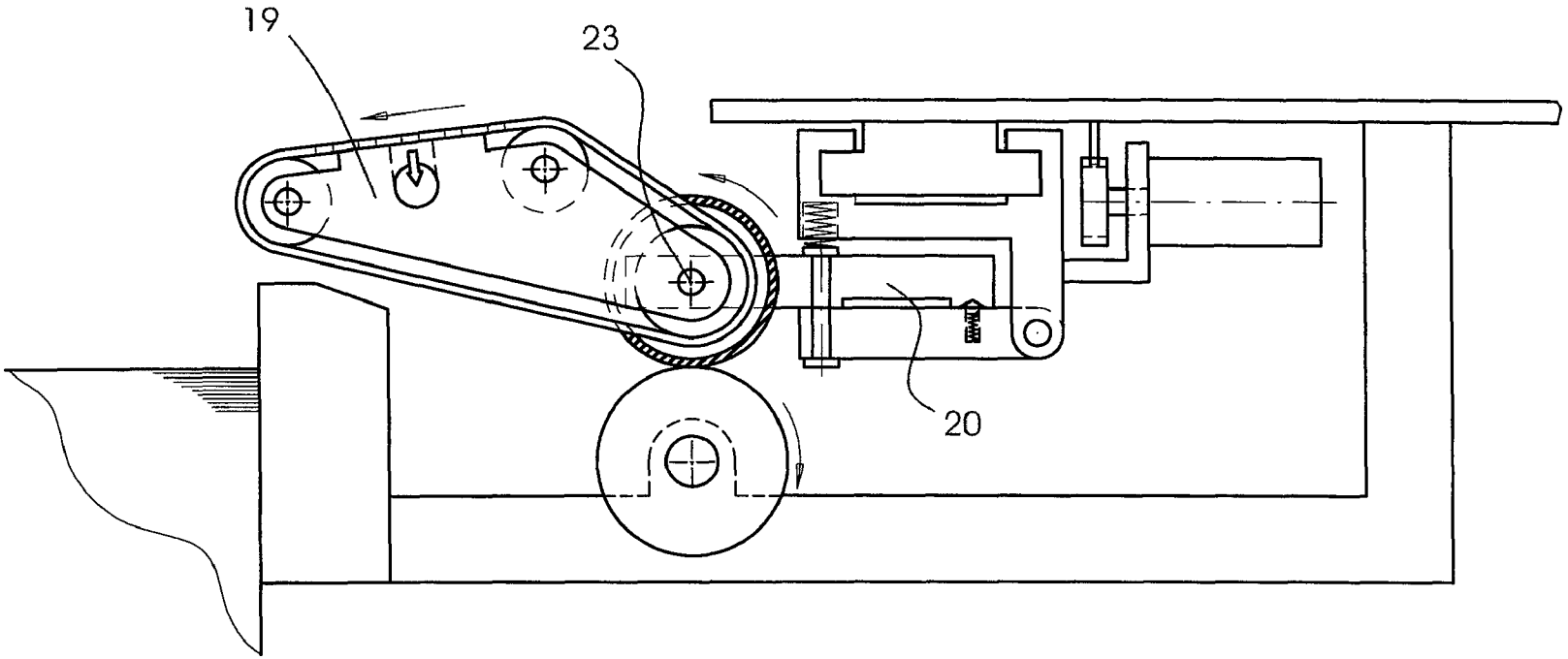

The brake module 19 can be pivoted about the horizontal axis 23 optionally into a position without inclination (see FIG. 3) and into a position with inclination (see FIG. 4). The position with the inclination, in which position a brake run of a brake band 26 which makes contact with the printed sheets during braking is inclined downward toward the delivery stack 3, serves in certain print jobs for improving the depositing of the printed sheets on the delivery stack 3. In that inclination position, as viewed in the sheet running direction, the brake run falls away at an acute angle relative to the horizontal. In order to lock the position with or without inclination which is selected in each case as a function of the print job, there is a latching device 25, the construction of which corresponds substantially to that of the latching device 24. The latching balls and the compression springs of the latching device 25 are seated in the module carrier 20 and the index holes are made in the brake module 19. The brake module 19 includes the endless brake band 26 which, during braking of the printed sheet, makes contact with the latter in a print-free corridor or edge strip. Moreover, the brake module 19 includes a drive roller 27 for driving the brake band 26 and deflection rollers 28, 29, around which the brake band 26 circulates. The geometric rotational axes of the rollers 27 to 29 define revolution axes 41, 42, 43 of the brake band 26. The revolution axis 41 is identical with the above-mentioned horizontal axis 23. The brake module 19 has a vacuum-loaded suction chamber 30 between the two deflection rollers 28, 29. The suction chamber 30 is open toward the brake band 26 and attracts the printed sheet by suction through perforations 31 in the brake band 26 to the latter.

Instead of the brake band 26, a pair of endless round belts could also be used which run parallel in such a way that the opening of the suction chamber 30 is situated between the round belts, in order to bring the printed sheet into contact with the round belts by suction force. In this modification, the drive roller 27 and the deflection rollers 28, 29 would have to be provided in each case with two circumferential-side annular grooves for guiding the round belts.

As is shown in FIG. 3, a friction wheel 32 which is held in contact with the drive roll 9 by a spring 33 is disposed coaxially with the drive roller 27. The spring 33 is a compression spring and is supported on the carriage 15 with its one end and is supported on the swinging arm 18 with its other end through the module carrier 20. The spring 33 is under prestress and tends to pivot the swinging arm 18 together with the friction wheel 32 counter to the clockwise direction around the joint 21 with regard to FIG. 3.

This torque, which is brought about by the spring 33 and holds the friction wheel 32 in contact with the drive roll 9, is reinforced by a torque which is oriented in the same direction and is caused during braking of the printed sheet by the friction which acts between the printed sheet and the brake band 26. The force action point of the friction-related force which brings about the additional torque is situated in the upper section of the brake band 26 which lies between the deflection rollers 28, 29, for instance in the region of the suction chamber 30, and in the plane of contact between the printed sheet and the brake band 26. As a result of the selection of the position of the joint 21 in such a way that, as viewed horizontally, the friction wheel 32 is situated between the joint 21 and the force action point and in such a way that, as viewed vertically, the joint 21 is situated below the force action point, active geometric lever arms are present which ensure pressing of the friction wheel 32 onto the drive roll 9. That pressing is reinforced automatically during braking of the printed sheet.

The friction wheel 32 is provided on the circumferential side with an elastomeric friction lining 34 and is connected fixedly in terms of rotation to the drive roller 27. Instead of the rotationally fixed connection, the friction wheel 32 and the drive roller 27 could also be manufactured in a single piece.

In the following text, the method of operation of the sheet brake system 2 will be described. The drive motor 8 is actuated by the electronic control device according to a speed profile which is stored therein, in such a way that it rotates in the case of a constant printing speed at a non-uniform speed. In this case, the drive motor 8 is actuated in such a way that, at a constant printing speed, it is accelerated and decelerated periodically, in a manner which corresponds to the conveying cycle of the printed sheets. Accordingly, the drive roll 9 and the brake bands 26 are also accelerated and decelerated cyclically or periodically. The speed profile is defined in such a way that the brake bands 26 circulate at a comparatively high speed when the suction chambers 30 suck the printed sheet which is to be braked into contact with the brake bands 26. After the contact between the printed sheet and the sheet brake 4, the latter is decelerated, with the result that the printed sheet is deposited at a comparatively low depositing speed onto the delivery stack 3 by the sheet brake 4. The circulating movement of the brake bands 26 is symbolized with an arrow in FIG. 3.

The rotational movement of the drive motor 8, which is a drive that is separate from the main drive of the printing press 1, is transmitted frictionally to the respective friction wheel 32 through the drive roll 9. The circulating movements of the drive roll 9 and the friction wheel 32 are likewise symbolized with arrows in FIG. 3. The circulating movement is transmitted from the friction wheel 32 to the brake band 26 through the drive roller 27. As a result of the oblique position of the two outer brake bands 26, which diverges according to the angles $+\alpha$, $-\alpha$, the two outer brake bands 26 in each case have a speed component which is transverse with respect to the sheet running direction. As a result of the two transverse speed components of the outer sheet brake 4 which are directed away from one another, the sheet is pulled apart laterally a little during braking, that is to say is tautened in the transverse direction, as a result of which the sheet delivery on the delivery stack 3 is improved.

The above-described kinematic features (sheet brake synchronizing) and the features which relate to the transverse tautening of the sheets, are also valid in a transferred meaning for the exemplary embodiments which are described in the following text, and therefore do not need to be repeated in this regard.

Figure 5:
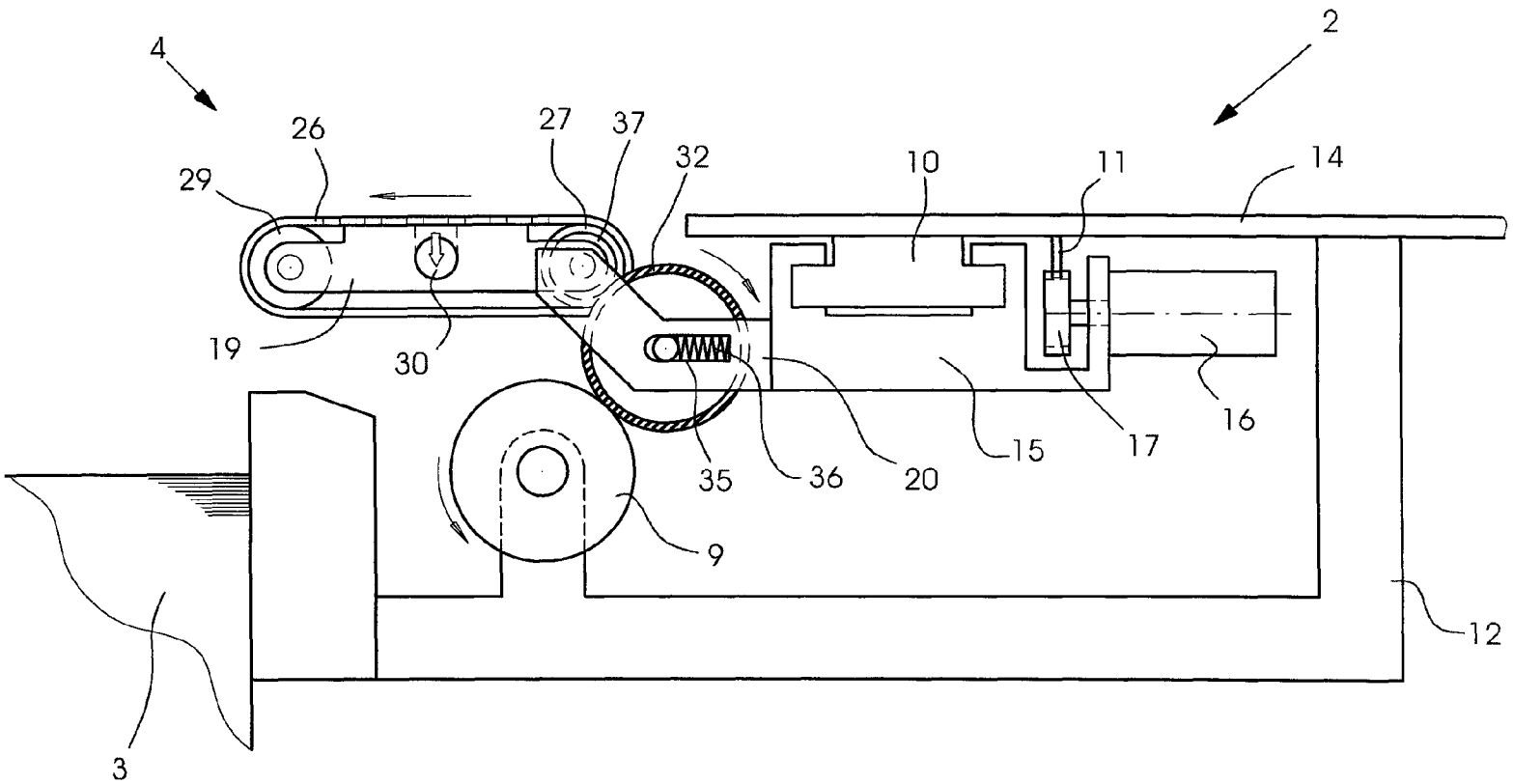
FIG. 5 is a fragmentary, side-elevational view of a second exemplary embodiment, in which the brake elements are likewise configured as endless bands and friction wheels are disposed offset eccentrically with respect to band rollers.

FIG. 5 shows an exemplary embodiment which differs from the exemplary embodiment that is shown in FIGS. 1 to 4 only with regard to the differences which are explained in the following text. In the sheet brake system 2 according to FIG. 5, the brake module 19 of the respective sheet brake (of the sheet brake 4 in the example shown) includes only a single deflection roller 29, with the other being omitted. The swinging arm 18 is likewise omitted. The module carrier 20 is connected rigidly to the carriage 15 and could instead also be of a single piece configuration with the latter. The consequence of this is that, in the exemplary embodiment according to FIG. 5, the possibility of the oblique position of the brake module 19 for the purpose of transverse tautening of the sheets has been omitted.

In a deviation from this, it is also conceivable, however, to connect the module carrier 20 to the carriage 19 through a joint which has a vertical pivot axis, with the result that the brake module 19 in FIG. 5 could be pivoted into the various oblique positions, like the brake module in FIG. 3, and to provide a latching device for securing the brake module 19 in the various oblique positions. It is likewise conceivable to pivot the brake module 19 about the geometric rotational axis of the drive roller 27 optionally into a horizontal position which is analogous to FIG. 3 and into an inclined position which is analogous to FIG. 4. Such pivoting is favorable when setting up the sheet brake system 2 for certain print jobs.

As is shown in FIG. 5, the friction wheel 32 is mounted in the module carrier 20 in such a way that it can be adjusted through a linear guide 35, and is loaded by a spring 36. The linear guide 35 includes a slot in the module carrier 20 and a pin which can be displaced in the slot and on which the friction wheel 32 is mounted rotatably. The module carrier 20 has a U-shaped or forked configuration and the friction wheel 32 is disposed between the two limbs or fork arms of the module carrier 20. The linear guide 35 and the spring 36 are provided in each case once in each fork arm, in a configuration on both sides.

In a modification (not shown in the drawing) from the exemplary embodiment which is shown in FIG. 5, the friction wheel 32, the linear guides 35 and the springs 36 are not mounted in the module carrier 20, but in the brake module 19, with the result that, during changeover of the sheet brake system to a following print job, the friction wheel 32 can be removed from the printing press 1 by the operator together with the remaining constituent parts of the brake module 19.

In the exemplary embodiment which is shown in FIG. 5, the spring 36 is a compression spring and is disposed in such a way that it presses the friction wheel 32 against the drive roll 9 and at the same time against a friction roller 37. The friction roller 37 is disposed coaxially with the drive roller 27 and is connected to the latter fixedly in terms of rotation. Instead of this, the friction roller 37 and the drive roller 27 could also be manufactured from one piece. The rotational movement of the drive roll 9 is therefore transmitted with a frictional connection to the friction wheel 32 and from the latter to the friction roller 37 likewise through circumferential friction.

Figure 6:
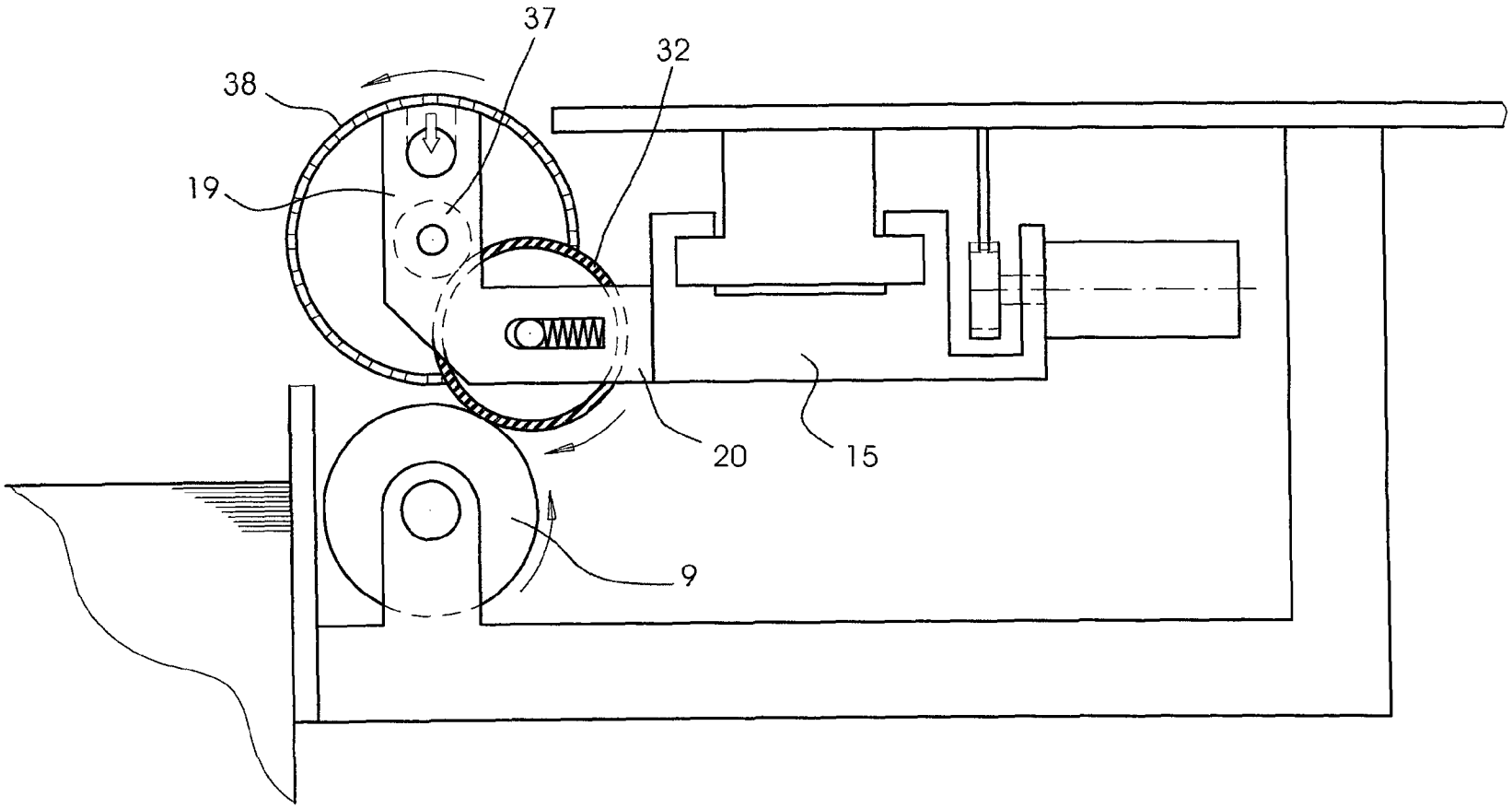
FIG. 6 is a fragmentary, side-elevational view of a third exemplary embodiment, in which the brake elements are configured as suction disks and friction wheels are disposed offset eccentrically with respect to the suction disks.

FIG. 6 shows an exemplary embodiment which has the friction wheel mechanism in common with the exemplary embodiment that is shown in FIG. 5, and which differs from that exemplary embodiment only as a result of the configuration of the brake module 19. In this case, instead of the brake band, the brake module 19 includes a brake disk 38 as a brake element which makes contact with the printed sheet. Accordingly, the drive roller 27 and the deflection roller 29 (see FIG. 5) are omitted and the friction roller 37 is connected fixedly in terms of rotation to the brake disk 38 or is of a single piece configuration with the latter. The brake disk 38 is a suction disk which is configured with circumferential-side perforations for attracting the printed sheet by suction and is mounted rotatably in the module carrier 20.

Figure 7:
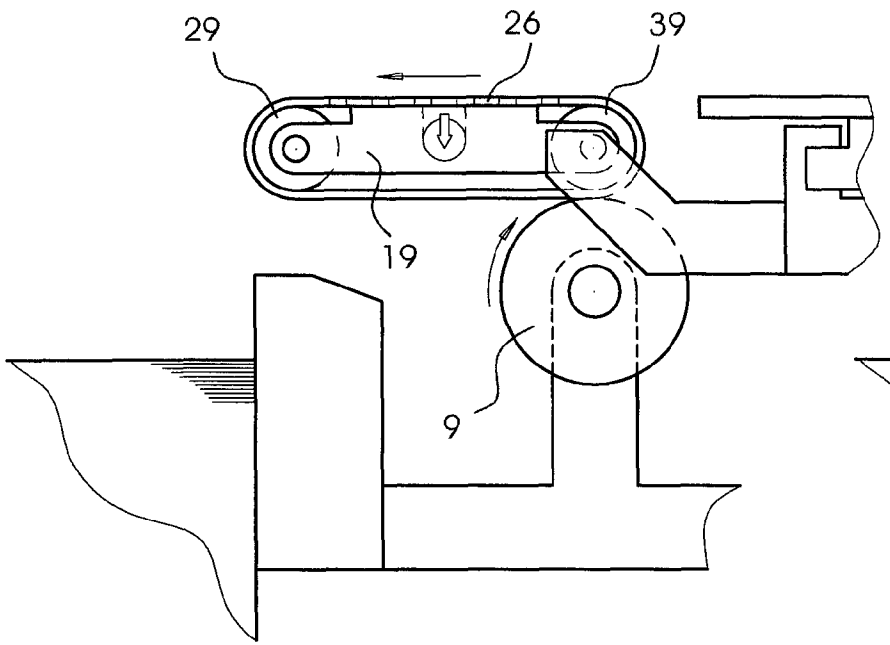
FIG. 7 is a fragmentary, side-elevational view of a fourth exemplary embodiment, in which the brake elements are configured as endless bands and a drive roll is in direct contact with the endless bands.

FIG. 7 shows an exemplary embodiment which differs from the exemplary embodiment that is shown in FIG. 5 as a result of the omission of the friction roller 37 and the friction wheel 32 including the linear guides 35 and the springs 36. The drive roll 9 bears directly against the brake band 26 on the outer side of the latter. The point of contact between the brake band 26 and the drive roll 9 is selected in such a way that, at this contact point, the brake band 26 is supported on the inside by a back pressure roller 39 which is disposed in place of the drive roller 27 (see FIG. 5). As a result of the elastic compression of the brake band 26 which takes place in a gap between the drive roll 9 and the back pressure roller 39, a frictional connection which is sufficiently high for torque transmission from the drive roll 9 to the brake band 26 is ensured under all conditions.

Figure 8:
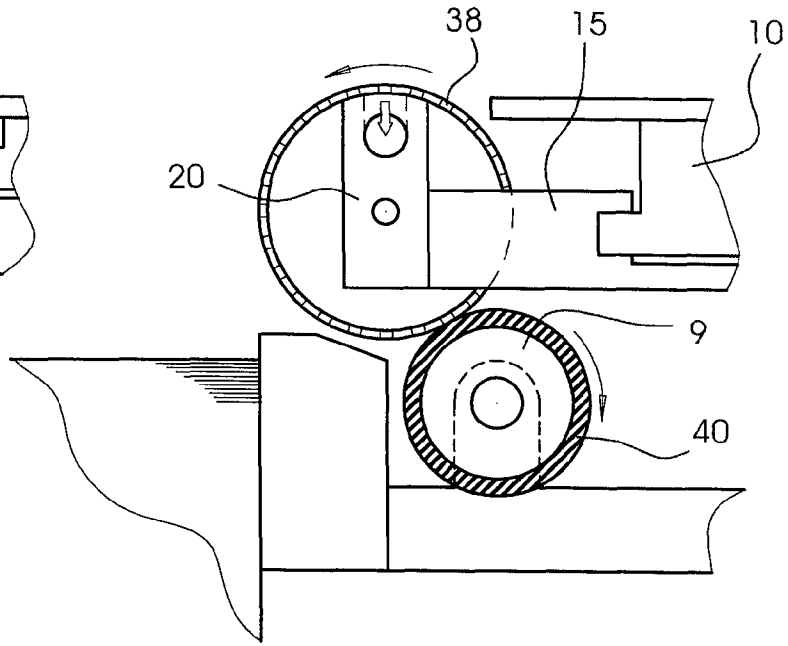
FIG. 8 is a fragmentary, side-elevational view of a fifth exemplary embodiment, in which the brake elements are configured as suction disks and a drive roll is in direct contact with the suction disks.

FIG. 8 shows an exemplary embodiment which in principle represents a combination of the exemplary embodiments that are shown in FIGS. 6 and 7. The exemplary embodiment which is shown in FIG. 8 differs from that shown in FIG. 7 only in that the brake module 19 has a brake disk 38 instead of the rollers 29, 39 and the brake band 26 which runs over them, like that shown in FIG. 6. Since the circumferential surface of the brake disk 38 is not elastic, and the drive roll 9 bears against that circumferential surface, the drive roll 9 is provided on the circumferential side with an elastomeric friction lining 40.

A control method, which is advantageous with regard to the reduction of abrasion wear and with regard to the removal of contaminants which are seated firmly on the drive roll 9, for example remains of a powder which is used in the sheet delivery 45 for powdering the printed sheets, includes the following: if one or more of the actuating motors 16 of the sheet brakes 4 to 6 are activated by the electronic control device, in order to move the sheet brakes 4 to 6 along the guide cross member 10, the drive motor 8 is likewise activated by the electronic control device. This ensures that the drive roll 9 rotates during the lateral movement of the sheet brake or sheet brakes. This control method can be used in each of the exemplary embodiments which are shown in FIGS. 1 to 8.

The invention claimed is:

1. A sheet brake system for braking printed sheets, the sheet brake system comprising:

a plurality of brake elements each circulating about at least one respective geometric revolution axis, each of said brake elements being a constituent part of a respective brake module mounted pivotably about a substantially vertical pivot axis;

module carriers each being fastened to a respective one of said brake modules, said module carriers each being pivotable about a respective joint having a horizontal pivot axis; and a common drive roll for driving said brake elements, said drive roll circulating about a geometric roll axis, and said drive roll being connected in drive terms to each of said brake elements through a frictional contact of said drive roll;

said geometric roll axis being disposed offset eccentrically relative to each said at least one revolution axis of each of said brake elements.

2. The sheet brake system according to claim 1, wherein said brake elements are endless brake bands or belts and do not wrap around said drive roll.

3. The sheet brake system according to claim 1, which further comprises friction wheels each being associated with a respective one of said brake elements, said friction wheels bearing against said drive roll to form said frictional contact.

4. The sheet brake system according to claim 3, wherein each of said friction wheels is loaded by at least one respective spring to ensure said frictional contact.

5. The sheet brake system according to claim 3, which further comprises friction rollers each being associated with a respective one of said brake elements and disposed coaxially with a revolution axis, said friction wheels each bearing against a respective one of said friction rollers to form a further frictional contact.

6. The sheet brake system according to claim 1, which further comprises:

swinging arms each being connected in an articulating manner with a respective one of said module carriers to form a respective one of said substantially vertical pivot axes; and carriages each being connected to a respective one of said swinging arms through a respective one of said joints having a horizontal pivot axis.

7. A sheet delivery, comprising a sheet brake system according to claim 1.

8. A printing press, comprising a sheet delivery having a sheet brake system according to claim 1.

* * * * *